US006315011B1

(12) United States Patent
Smith

(10) Patent No.: US 6,315,011 B1
(45) Date of Patent: Nov. 13, 2001

(54) AIR-RELIEF FILTER NOZZLE ASSEMBLIES

(75) Inventor: Mark J. Smith, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/613,365

(22) Filed: Jul. 10, 2000

(51) Int. Cl.[7] ..... B67C 11/00
(52) U.S. Cl. ..... 141/299; 141/59; 141/300
(58) Field of Search ..... 141/59, 297–300

(56) References Cited

U.S. PATENT DOCUMENTS

| | | | | |
|---|---|---|---|---|
| 279,739 | * | 6/1883 | Gifford | 141/299 |
| 313,049 | * | 3/1885 | Bolus et al. | 141/299 |
| 618,996 | * | 2/1899 | Riedel et al. | 141/297 |
| 3,306,323 | * | 2/1967 | Aronson | 141/299 |
| 4,828,770 | | 5/1989 | Fabian et al. | 264/40.3 |
| 4,850,403 | * | 7/1989 | Wiese | 141/300 |
| 5,221,945 | | 6/1993 | Smith | 355/260 |
| 6,024,141 | | 2/2000 | Wegman | 141/59 |
| 6,119,739 | * | 9/2000 | McGee et al. | 141/299 |

* cited by examiner

*Primary Examiner*—J. Casimer Jacyna
(74) *Attorney, Agent, or Firm*—Perman & Green, LLP

(57) ABSTRACT

Dual cone funnel assembly for simultaneously introducing a flow of particulate composition, or powder, into a receiving container through a dispensing tube along one path while channeling the flow of displaced air through an annular air-exhaust space along a different path surrounding the first path. The funnel assembly has an inner funnel supply element surrounded and closely-spaced from an outer funnel element to provide the annular air-relief space therebetween.

The assembly may be used to feed particulate resinous extrusion composition through a dispensing funnel element to the premelt chamber of an extruder and to isolate and return the displaced air to a dust collection element.

8 Claims, 1 Drawing Sheet

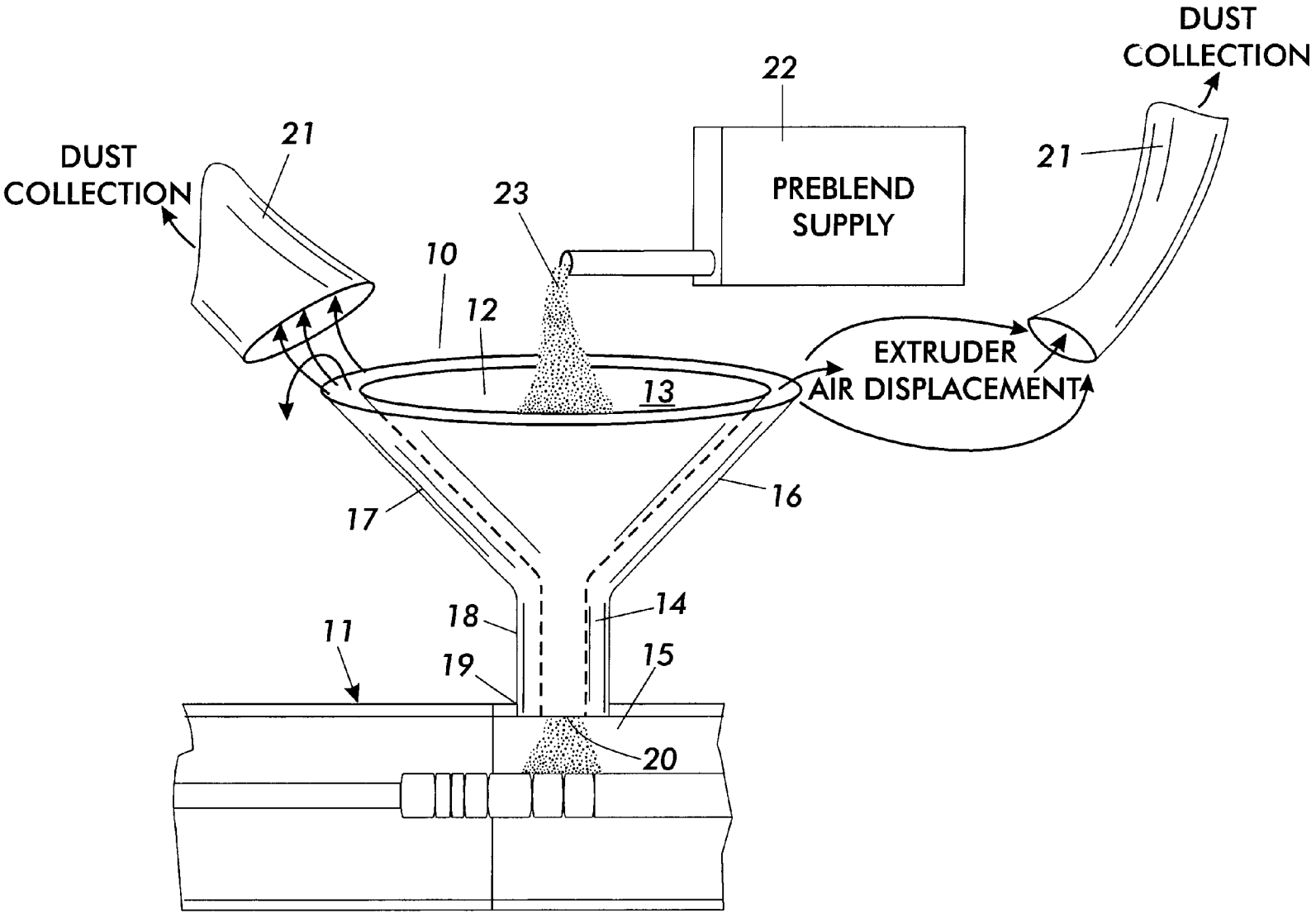
DUST COLLECTION
21
EXTRUDER AIR DISPLACEMENT
PREBLEND SUPPLY
22
16
13
14
15
20
23
12
10
18
19
17
11
21
DUST COLLECTION

AIR-RELIEF FILTER NOZZLE ASSEMBLIES

BACKGROUND OF THE INVENTION

1. Field of the Invention

The present invention relates to improvements in supply funnel devices such as hoppers, conduits and related containers for dispensing and feeding solid particulate materials or powders such as toner compositions, meltextrusion compositions and similar finely-divided particulate compositions to a receptor container such as a toner cartridge or compartment, an extruder or any other empty, air-filled receptor container to be filled with the solid particulate composition.

2. State of the Art

It is recognized that the dispensing of finely-divided particulate compositions or powders from supply containers, through tapered or restricted spouts, into empty receptor containers results in the displacement of air from the empty receptor container and back-flow through the spout and into the supply container. This escape of air results in a counter-current of air against the flow of the solid particulate composition, which impedes throughput, negatively affects product quality, can create a safety concern (fire), reduces fill rate and work rate such as the extrusion rate. Moreover, fines or dust-size particles can become airborne and can pollute the atmosphere in the work area into which the displaced air is discharged.

Reference is made to U.S. Pat. 6,024,141 which discloses a fluidizing nozzle system for dispensing particulate powder compositions from a spiral auger such as toner compositions, which tend to be abrasive, easily charged and self-agglomerating so as to clog and resist flow. Dispensing is improved by providing the nozzle with a porous inner wall surface and force-feeding a supply of compressed gas into a plenum and through the nozzle wall to aerate and fluidize the toner composition, prevent sticking and agglomeration, and thereby facilitate flow into the receptor container. Preferably, the porous wall plenum also was an outlet which communicates with a vacuum source for eliminating positive pressure from the receptor container and removing stray airborne particulates.

Such systems are complex, involve the introduction of additional air into the particulate powder composition which can reduce the powder flow rate unless a spiral auger or other mechanical flow-inducer is used, and expose the receptor container to a vacuum pressure which can withdraw excessive amounts of the fluidized powder composition at the mouth of the receptor container.

Reference is also made to my U.S. Pat. No. 5,221,945 which discloses a toner cartridge having a closed supply compartment for feeding toner powder to a hopper when a floor seal is peeled away to open the compartment to the hopper. A passageway is provided through the toner powder to permit air, which becomes displaced from the hopper, to flow back into the closed toner compartment, above the level of the toner powder. This prevents the displaced air from impeding the flow of the toner powder and equalizes the air pressure within the supply compartment.

While such toner cartridges are effective for their intended purposes, they are restricted to the feeding of toner powder from a closed supply container having a retractable floor slide which first opens the air passageway to the receptor hopper and then opens the supply container for the gravity flow of toner powder. Such systems are not useful for the continuous large batch supply of particulate compositions, such as extrusion compositions, from a continuously fed supply hopper. Moreover, the area of air-relief is localized at one side of the particulate flow causing the path of some of the escaping air to intersect the path of the particulate flow, resulting in turbulence and aeration and escape of some of the smaller particulates with the escaping air.

SUMMARY OF THE INVENTION

According to the present invention particulate or powder supply or dispensing devices such as hoppers, conduits, funnels or similar containers comprise a depending elongate restricted dispensing funnel or tube, preferably downwardly-tapered or conical for receiving a solid particulate composition, or powder, from a central location at the base of the supply container and for conveying it into a receiving container. The invention is characterized by surrounding the outer wall of the dispensing funnel or tube with one or more peripheral air relief passages which open into the receiving container, on all sides of the outlet of the dispensing funnel or tube, for receiving air displaced from the receiving container by the particulate composition or powder and for channeling and exhausting said air, preferably externally of the supply container, and most preferably into an enclosed dust collection and/or recovery system isolated from the workspace environment.

According to a preferred embodiment of the invention, the dispensing funnel and the air relief passage are constituted by a dual cone construction having a central dispensing funnel surrounded by and closely spaced from an outer funnel by a narrow peripheral air relief passage, whereby solid particulate composition or powder can be funneled into a receiving container through the central dispensing funnel outlet as a central incoming particulate flow, while air displaced from the receiving container can enter the narrow air relief passage from all directions, surrounding the particulate flow, for intersecting without disrupting the incoming particulate flow, thereby maximizing the filling rate of the receptor container and minimizing the creation and aeration of particulate fines or dust and the exhaust thereof with the displaced air.

BRIEF DESCRIPTION OF THE DRAWINGS

The foregoing aspects and other features of the present invention are explained in the following description, taken in connection with the accompanying drawings, wherein:

FIG. 1 is a perspective view of an air-relief filler funnel assembly for an extrusion machine, according to a preferred embodiment of the present invention.

DETAILED DESCRIPTION OF THE PREFERRED EMBODIMENT

Referring to FIG. 1, the particulate or powder supply and dispensing container thereof is a dual cone funnel 10 sealingly connected to a resin extruder 11 as an assembly.

The dual cone funnel 10 comprises an inner particulate supply funnel element 12 having a large upper conical supply section 13 which gradually tapers down to a central restricted depending dispensing tube or funnel section 14 which opens into a receiving container 15 which, in the illustrated embodiment, is the resin preblend supply chamber of a conventional melt extrusion apparatus 11.

The dual cone funnel 10 also comprises an outer funnel element 16 which is similar in shape to the inner funnel element 12 but larger overall so as to enclose the latter and its depending section 14 and to be closely-spaced therefrom to provide an intermediate, narrow, annular air-relief passage 17 between the funnel sections 12–16 and 14–18. The outer funnel element also contains the central restricted depending tube or funnel section 18, the base 19 of which is sealingly attached, such as frictionally or threadable, to the extruder 11 to enclose the particulate inlet port to the preblend receiving chamber 15. The base 20 or outlet end of the central funnel dispensing tube 14 extends down into the receiving chamber 15, surrounded peripherally by the air-relief passage 17, and the inner and outer funnel sections 12 and 16 are supported in spaced relation to each other in any conventional manner. For example, the funnel sections may be fixed to each other by spaced vertical ribs or weld areas therebetween, or a plurality of spacers may be attached to one of the facing funnel surfaces to permit the inner funnel section 12 to be lifted out and removed for periodic cleaning.

As further illustrated by FIG. 1, the air-relief space 17 between the upper lips or rims of the funnel elements 12 and 16 may be open to dust collection elements 21 or more preferably, in closed communication with a single peripheral annular dust collection element which collects all of the displaced air and dust particles to protect the work environment.

FIG. 1 also illustrates a particulate supply conduit or container 22 for supplying conventional particulate extrusion composition such as a finely divided resin preblend or premelt 23 to the upper section 13 of the supply funnel element.

In operation the preblend 23 flows freely into and through the lower funnel tube 14, unimpeded by any back-flow of displaced air since the displaced air is able to escape up into the surrounding annular air-relief passage 17. This facilitates and increases the flow rate of the particles to the extruder and enables the extrusion rate to be increased.

While the drawing illustrates the use of the present air-relief filler assemblies in association with an extruder, it should be understood that the filler assemblies can be used for the filling of substantially any receptor container with substantially any appropriate flowable particulate composition. For example xerographic toner powders may be introduced to toner cartridges or toner compartments of xerographic copy machines by means of the present air-relief filler assemblies.

Moreover, the present dual-cone air-relief filler assemblies need not be round or circular in cross-section but may consist of cones which are square in cross-section or have more than four sides. Preferably they are formed of stainless steel, but other metals or plastics are suitable depending upon the heat-resistance and other requirements of the end use.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A dual cone funnel assembly for feeding a finely-divided flowable particulate composition into a receptor container and for exhausting air displaced from said container, comprising an inner central cone funnel having a large upper funnel section for containing a supply of said particulate composition, opening into a depending restricted dispensing section for communicating with a receptor container, and a larger outer cone funnel closely-spaced from and surrounding said inner central cone section and said dispensing section to provide an annular air-exhaust space between said cone sections for receiving and channeling air displaced from the receptor container through said annular space outwardly from and surrounding the pathway of the flow of particulate composition dispensed into the receptor container, and an air-collection element in closed communication with the upper area of said annular air-exhaust space to isolate the displaced air and any particulate dust contained therein from the workplace.

2. A dual cone funnel assembly according to claim 1 in which the outer cone funnel has a depending lower section, surrounding the dispensing section of the inner central cone, which is in closed communication with an inlet of the receptor container.

3. A dual cone funnel assembly according to claim 2 in which the receptor container comprises the premelt chamber of an extrusion apparatus, and the particulate composition comprises an extrusion resin preblend.

4. A dual cone funnel assembly according to claim 1 in which the receptor container comprises a xerographic toner cartridge.

5. A dual cone funnel assembly according to claim 1 in which said inner and outer cone funnels are connected to each other by means of spacers therebetween.

6. A dual cone funnel assembly according to claim 5 in which said spacers comprise spaced ribs.

7. A dual cone funnel assembly according to claim 5 in which said spacers comprise spaced welds.

8. A dual cone funnel assembly according to claim 5 in which said inner and outer cone funnels are removably connected to each other by said spacers.

* * * * *